United States Patent [19]

Sauvage

[11] 4,178,985

[45] Dec. 18, 1979

[54] INSTALLATION FOR MANUFACTURING A METAL WIRE BY CONTINUOUS CASTING

[75] Inventor: Philippe Sauvage, Clermont-Ferrand, France

[73] Assignee: Compagnie Generale des Etablissements Michelin, Clermont-Ferrand, France

[21] Appl. No.: 865,608

[22] Filed: Dec. 29, 1977

[30] Foreign Application Priority Data

Jan. 10, 1977 [FR] France ..... 77 00667

[51] Int. Cl.[2] ..... B22D 27/02; B22D 11/00; B22D 11/12

[52] U.S. Cl. ..... 164/250; 164/423; 164/441; 164/442; 164/443; 164/444

[58] Field of Search ..... 164/48, 50, 82, 250, 164/268, 423, 441, 442, 443, 444

[56] References Cited

U.S. PATENT DOCUMENTS

| | | | |
|---|---|---|---|
| 3,461,943 | 8/1969 | Schile | 164/48 X |
| 3,896,870 | 7/1975 | Massoubre | 164/423 |

*Primary Examiner*—Othell M. Simpson
*Assistant Examiner*—Gus T. Hampilos
*Attorney, Agent, or Firm*—Brumbaugh, Graves, Donohue & Raymond

[57] ABSTRACT

Installation for manufacturing wire by projecting a jet of electrically conductive metallic liquid through a die into a cooling medium, comprising a crucible equipped with a heating device, a die and an enclosure containing a gas under pressure, an enclosure containing a cooling medium and a wire-receiving device is improved by providing the installation with a thermally and electrically conductive immobile hot piece arranged in such a manner as to debouch into the section of a crucible passageway which is wetted by the metallic liquid, occupies that section and is in contact with a cooling element and with one of the poles of a source of electric current, while an electrically conductive cold piece is connected to the other pole of the source of electric current and assures electrical contact with the jet or the wire.

13 Claims, 4 Drawing Figures

INSTALLATION FOR MANUFACTURING A METAL WIRE BY CONTINUOUS CASTING

Figure 1:
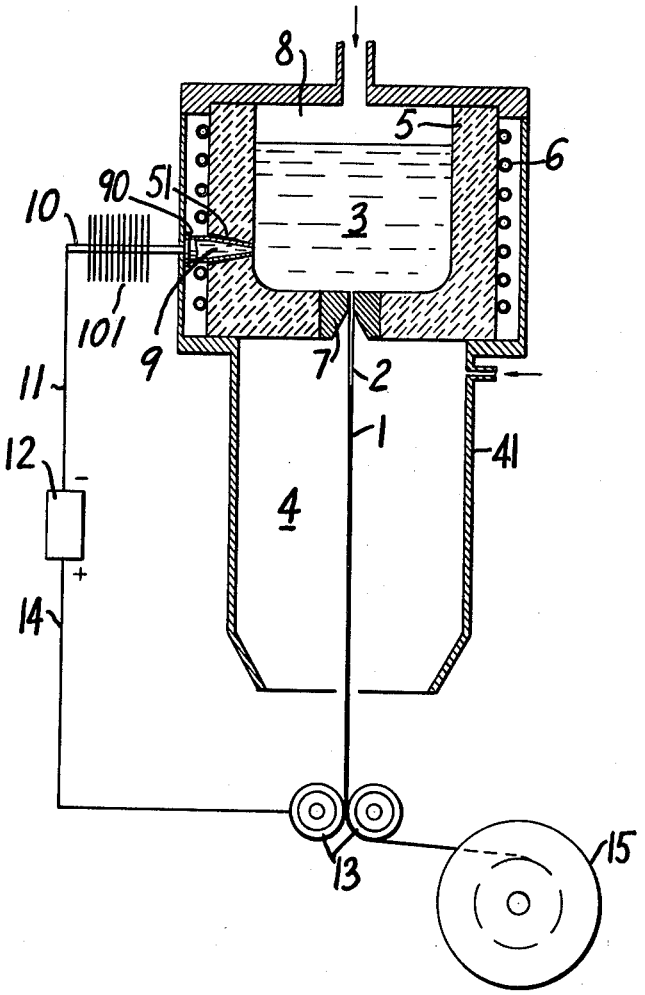

This invention relates to installations intended for the manufacture of wire by projecting a jet of liquid metal or metal alloy through a die into a cooling medium.

Such installations comprise a crucible containing liquid metal or metal alloy (hereinafter called liquid mass), and provided with heating means and a die as well as with means for exerting a pressure on the liquid metal or metal alloy so as to project it in the form of a jet into the cooling medium, and, arranged following the die, a cooling enclosure containing the cooling medium and in which the liquid jet is transformed into solid wire. This wire then reaches a receiving device in order, for instance, to be wound up, shaped, or transferred for some other use.

In certain cases, some examples of which are mentioned further below, it is necessary for the jet and/or wire to conduct an electric current or be capable of being brought to an electric potential. The difficulty consists in maintaining the electric contact with the liquid mass in the crucible.

When it is desired to introduce the electric current into it by means of an electrode immersed in the liquid mass, the following drawbacks, in particular, are encountered.

In order to assure constant quality of the wire produced, it is desirable to exert a constant pressure on the liquid mass. Now it has been found that the presence of the electrode disturbs the means used to exert this pressure and, therefore, the constancy of this pressure.

The electrode and/or the liquid mass may become contaminated due to the temperature of the liquid mass and/or their respective compositions.

The object of the present invention is to provide means for establishing and maintaining electric contact with the liquid mass, without the above drawbacks.

In accordance with the invention, in an installation of the type described above for the manufacture of wire by projecting a jet of liquid metal or metal alloy into a cooling medium, this means consists in providing:

at least one passageway in that portion of the crucible which is wetted by the liquid mass, at least one part, called the hot piece, which is a conductor of heat and electricity and is arranged in such a manner that it debouches into a section of said passageway wetted by the liquid mass and occupies said section, said piece being also in contact with a cooling means and with one of the poles of a source of electric current, means for holding the hot piece immobile with respect to the crucible against the pressure of the liquid mass, at least one other part, called the cold piece, which is a conductor of electricity and is connected to the other pole of the source of electrical current, it being of a shape and arrangement suitable for assuring electrical contact with the jet or wire, and electrical insulating means between the hot piece and the cold piece.

By "electrical contact" between the jet or wire and the cold piece, there is understood not only physical contact between the jet or wire and the cold piece but also either a flow of current by an electric arc between the jet or wire and the cold piece or an electrostatic field between the jet or wire and the cold piece.

It is not necessary for the end of the hot piece to emerge from the wall of the crucible. Said end is advantageously flush with the crucible's inner wall which is wetted by the liquid mass.

Moreover, since the hot piece is a heat sink, it is unnecessary to provide means to assure tightness between the passageway in the crucible and said hot piece. In fact, under the pressure of the liquid mass, said liquid mass infiltrates between the passageway and the hot piece, solidifies there, and forms a sealing joint.

Due to the structure and the arrangement of the hot piece, it is easy to make it of a material whose composition is identical to or similar to that of the liquid mass in the crucible. This makes it possible to minimize, if not exclude, the risk of contaminating the liquid mass. The electrical insulation of the hot piece is simple. The refractory material constituting the crucible is frequently an electrical insulator. In the event that said material is a conductor of electricity, then the crucible itself forms the hot piece in accordance with the invention.

In numerous cases the metal parts of the wire manufacturing installation may be placed at the same electrical potential, for instance grounded, and therefore the liquid mass in the crucible also is.

Under these conditions it is needless to provide special insulation for the hot piece passing through the wall of the crucible. On the other hand, it is easy, by conventional means, to provide electrical insulation of the cold piece which is intended to be connected to the other pole of the source of electric current. Said source is, in fact, arranged either downstream of the installation of the type in question or in a portion of said installation whose temperature is customarily close to ambient temperature and whose pressure is close to atmospheric pressure.

In order to immobilize the hot piece with respect to the crucible against the pressure of the liquid mass, any means can be employed.

The cooling means with which the hot piece is in contact furthermore may consist simply of a portion of the hot piece which is arranged within a medium whose temperature is lower than that of the liquid mass in the crucible, for instance in the ambient air. However, the hot piece can also be provided with a heat exchanger, e.g., metallic fins.

In all cases it is advisable to limit the surface of the hot piece which is in contact with the liquid mass. This favors the establishing of a large heat gradient along the hot piece while minimizing the risks of contamination and the losses of heat.

In accordance with the invention, the passageway for the hot piece in the portion of the crucible which is wetted by the liquid mass can be combined with the passageway present between the crucible and the die or the part bearing the die, the metallic seal-producing metal-fitting described in U.S. Pat. No. 3,896,870 then constituting the hot piece in accordance with the present invention.

As a matter of fact, one of the ends of the fitting occupies the cross section of the passageway which is wetted by the liquid mass. Moreover, this hot piece is in contact with a cooling means and its cylindrical shape as well as its arrangement make it possible easily to connect it to one of the poles of a source of current.

In accordance with one application of the invention, the cold piece has the shape of an electrically insulated electrode arranged in the cooling enclosure of the installation of the type in question near the liquid jet or anywhere in the vicinity of the path of the solid wire.

In accordance with a first variant of this use, sparks may be caused to fly in an electric arc established between said electrode and the jet or wire by means of a sufficient difference in potential supplied by the source of electric current. These sparks serve to transform the wire into filiform elements which can be used to reinforce continuous materials or aggregates of discontinuous materials.

In accordance with another variant of this use, an electrostatic field is formed between the jet or wire, on the one hand, and the electrode, on the other hand, by means of a suitable difference in potential. This electrostatic field may, for instance, serve to effect a depositing of material on the wire or to act on the trajectory of the jet and/or wire. It goes without saying that several cold pieces can be arranged along the trajectory of the jet and then of the wire. This makes it possible to effect different operations at different places of said trajectory.

Another use of the invention consists in employing as the cold piece the deflector which, in the installations of the type in question, serves to limit the free length of the wire and to facilitate its further transformation, this deflector being constructed of an electrically conductive material which is connected to one of the poles of the source of electric current.

As the cold piece, one may also employ a roller in contact with the wire, and forming part, for instance, of the guide device which receives the wire before, for instance, the wire is wound up. It is sufficient to make the deflector or roller electrically conductive and provide them with suitable insulation, the hot piece being placed at the ground potential of the installation.

In this application the wire is traversed by an electric current from the liquid mass up to the cold piece. In a first variant of this use, the trajectory of the wire can be modified by the application, by any known means, of a magnetic field perpendicular to the wire. This trajectory can thus be guided, stabilized, or modified.

A second variant consists in suitably selecting the intensity of the electric current with respect to the nature of the wire so as to heat the wire by a Joule's effect, for instance for thermal or mechanical treatment thereof.

Within the scope of these variants, the absence of electric current can also be detected and thus either the breaking of the wire or the dropping of the level of the liquid mass in the crucible signalled.

It is also included within the scope of the uses of the invention to modify the trajectory of the wire in the manner indicated above and then to cut the wire into filiform elements by causing sparks to fly between a second cold piece and the wire.

Figure 2:
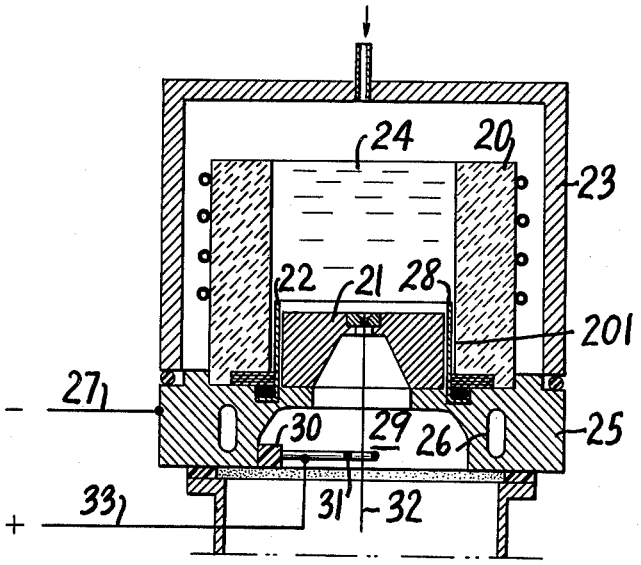
Figure 3:
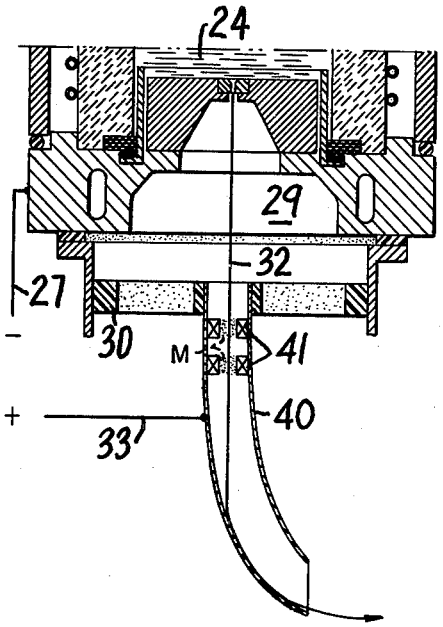
Figure 4:
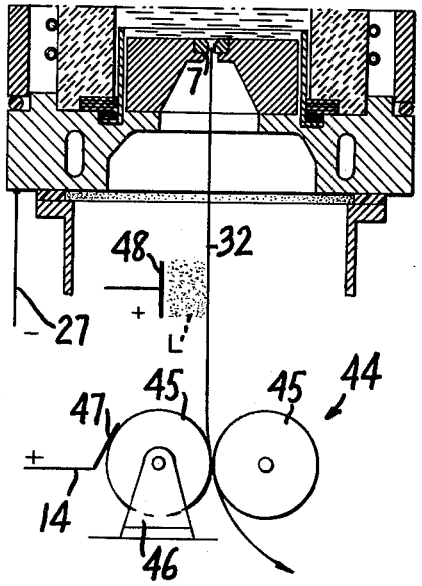

In the accompanying schematic drawing, which is intended to facilitate an understanding of the present invention by means of non-limitative illustrative examples, FIG. 1 is a view in longitudinal section illustrating the carrying out of the principle of the invention, FIG. 2 is a view similar to FIG. 1, illustrating a variant embodiment, and FIGS. 3 and 4 illustrate two variant embodiments of the invention in an installation in accordance with FIG. 2.

FIG. 1 shows an installation intended for the manufacture of the wire 1 by projecting a jet 2 of liquid metal or metal alloy 3 into a cooling medium 4.

The crucible 5, which is surrounded by a heating device 6, is provided with a die 7 and with an enclosure 8 containing a gas under pressure. In the part thereof wetted by the liquid mass 3, this crucible has a passageway 51 in which the hot piece 9 in accordance with the invention is housed.

The liquid mass 3 which is subject to the pressure of the gas in the enclosure 8 is projected in the form of a liquid jet 2 through the die 7. The hot piece 9 comprises a stop 90 which immobilizes it against the pressure of the liquid mass 3. The amount of liquid mass which has infiltrated between the wall of the passageway 51 and the hot piece 9 is solidified and forms, on the one hand, a joint between said passageway and the hot piece 9 and, on the other hand, a reliable electrical contact between the liquid mass 3 and the hot piece 9. The hot piece 9 which is flush with the inner wall of the crucible 5 is in contact with the liquid mass 3. On the portion 10 thereof which emerges into the ambient air, the hot piece 9 has metallic fins 101 which contribute towards lowering the temperature of said portion 10 as compared with the temperature of the hot piece 9 which is in contact with the liquid mass 3, which contributes to maintaining the infiltrate in solid state. The portion 10 of the hot piece 9 is connected by a conductor 11 to a source of electric current 12.

The cooling medium 4 is contained in an enclosure 41. The wire 1 penetrates between two rollers 13, at least one of which is a conductor of electricity and constitutes the cold piece. A conductor 14 connects said conductive roller 13 to the other terminal of the source of electric current 12. The transfer of the electric current between the conductor 14 and the roller 13 is effected by an ordinary device with collector and brush, not shown in the drawing. When the source of electric current 12 delivers current, this electric current flows between the hot piece 9 and the cold piece 13 along the jet 2 and the wire 1. Upon its emergence from the rollers 13, the wire is wound onto a winding device or bobbin 15.

FIG. 2 shows the crucible 20 of an installation (shown in part) of the type in question. This crucible is provided with a die holder 21, a seal-producing metallic fitting 22 being arranged in the passageway between the crucible 20 and the die holder 21, in accordance with U.S. Pat. No. 3,896,870. The die holder 21, the wall 201 of the crucible 20, and the enclosure 23 for the placing of the liquid mass 24 under gaseous pressure rest on a metal support 25, in the same way as the metal fitting 22. The support 25 is provided with a conduit 26 in which a cold-producing fluid flows. The source of electric current (not shown) is connected to the fitting 22 via a conductor 27 which in its turn is connected to the metal support 25 in contact with the fitting 22 which constitutes the hot piece in accordance with the invention. Due to the temperature gradient established between the liquid mass 24 and the support 25 via the fitting 22, a certain amount of the liquid mass 24 is solidified around the edge 28 of the fitting 22 which is wetted by the liquid mass 24 and forms, on the one hand, a sealing joint between the crucible 20 and the die holder 21 and, on the other hand, a satisfactory electrical contact between the liquid mass 24 and the fitting 22.

Within the cooling enclosure 29 an annular electrode 31, concentric to the liquid jet 32, is arranged on an insulating support 30. This annular electrode 31 forms the cold piece in accordance with the invention; when it is connected by the conductor 33 to the source of electric current, such as a high-voltage pulse generator, sparks fly between the cold piece 31 and the liquid jet 32. The liquid jet is cut at the location of the electrode 31 by the sparks which locally volatilize it. There are produced in this way longer or shorter filiform elements, for instance of steel, which can be advantageously employed as reinforcement for materials such as rubber, plastics, concrete, etc.

As shown in FIG. 3, the spark-generating electrode 31 can be eliminated in the cooling enclosure 29 of an installation such as that shown in FIG. 2 and replaced by an electrically conductive metallic deflector 40 mounted on an insulating support 30, and this deflector 40 can be connected to a source of electric current (not shown). An electric current flows from the liquid mass 24 through the liquid jet and the solid wire 32 up to the deflector 40 which forms the cold piece. Along the path of this current there are arranged one or more oriented magnetic fields M intended to stabilize the trajectory of the wire 32 in the direction of the deflector 40. This permits the wire 32 to arrive without incident at the winding device or bobbin (not shown).

The deflector 40 of FIG. 3 can also be replaced (FIG. 4) by a guide device 44 for the wire 32, which comprises a plurality of rollers 45, at least one of which is a conductor of electricity; this conductive roller may be mounted on insulating supporting pedestals 46 and be connected by brushes 47 to the conductor 14 coming from the source of electric current. In this variant, the current follows the wire up to the roller 45 which constitutes the cold piece.

Between the die 7 and the conductive roller 45 an electrode 48 which is subjected to a constant potential may furthermore be provided in the vicinity of the wire 32. This electrode 48 creates an electrostatic field between itself and the wire 32. One can in this way either deposit on the wire 32 a solid or liquid product which is atomized in the space between the electrode 48 and the wire 32, or establish a device intended to act on the trajectory of the wire 32.

I claim:

1. An installation for manufacturing wire by projecting a jet of electrically conductive molten metal through a die and subsequently through a cooling devie, said installation comprising:

a crucible adapted to contain molten metal and formed of an electrically insulating refractory material, said crucible being equipped with a heating device and provided with at least one passageway extending through a wall of said crucible;

a die for forming wire, associated with said crucible, and adapted to shape molten metal received from said crucible;

a closure member associated with said crucible to define an enclosure adapted to contain a gas under pressure;

means associated with said closure member for providing gas under pressure to said defined enclosure;

a cooling device associated with said crucible and said die and located to receive and cool said shaped metal exiting from said die and means for establishing and maintaining electrical contact with the metal throughout the manufacture, comprising:

(a) at least one hot piece, said hot piece being a conductor of heat and electricity, provided in said at least one passageway and sized so as to create a gap between said hot piece and walls defining said at least one passageway, said hot piece including two ends, one end of which extends at least to an interior wall of said crucible;

(b) means associated with said hot piece to cool said hot piece, said means to cool said hot piece being located to cool the other end of said hot piece remote from said end which extends at least to said interior wall of said crucible causing said hot piece to function as a heat sink to solidify molten metal which has entered said gap to produce a gas-and-metal-tight seal;

(c) a source of electrical current;

(d) means associated with said source and attaching one pole of said source with hot piece;

(e) means associated with said hot piece for holding said hot piece immobile with respect to said crucible against the pressure created by the presence of any pressurized metal in said crucible;

(f) at least one cold piece, said cold piece being a conductor of electricity, connected to another pole of said source of electricity and of a shape and arrangement suitable for assuring electrical contact with said shaped metal; and (g) means provided between said hot piece and said cold piece to electrically insulate said hot piece from said cold piece.

2. The installation according to claim 1, wherein said hot piece consists of a material which is identical to the material of said molten metal.

3. The installation according to claim 1, wherein said hot piece is grounded and said cold piece is electrically insulated from ground.

4. The installation according to claim 1, wherein said other end of said hot piece is arranged within a medium whose temperature is lower than that of said molten metal.

5. The installation according to claim 4, wherein said other end of said hot piece is equipped with a heat exchanger.

6. The installation according to claim 1, wherein said cold piece is an insulated electrode arranged near said shaped metal, said source of electric current connected between said cold piece and said hot piece supplying a sufficient potential difference to cause an electric arc to be established between said cold piece and said shaped metal.

7. The installation according to claim 1, wherein said source of electric current connected between said cold piece and said hot piece provides a potential difference which is suitable to create an electrostatic field between said cold piece and said shaped metal.

8. The installation according to claim 1, wherein said cold piece is formed of an electrically conductive deflector arranged in the trajectory of said shaped metal and connected to one of said poles of said source of electric current.

9. The installation according to claim 8, wherein the intensity of the electric current passing through said shaped metal is selected so as to treat said shaped metal thermally.

10. The installation according to claim 8, wherein the intensity of the electric current passing through said shaped metal is selected so as to treat said shaped metal mechanically.

11. The installation according to claim 8, wherein means for applying a magnetic field capable of modifying said trajectory of said shaped metal are provided along said trajectory of said shaped metal.

12. The installation according to claim 1, wherein said cold piece is formed of an electrically conductive roller which is electrically insulated and connected to said source of electric current.

13. The installation according to claim 12, wherein said roller is part of a guide device for said shaped metal.

* * * * *